US005899147A

United States Patent [19]

Clayton

[11] Patent Number: 5,899,147

[45] Date of Patent: May 4, 1999

[54] ADJUSTABLE SHELF FOR USE ABOUT AN OPENING IN A WALL

[76] Inventor: Steven S. Clayton, 8451 S. College, Tulsa, Okla. 74137

[21] Appl. No.: 08/962,388

[22] Filed: Oct. 31, 1997

[51] Int. Cl.[6] ..... A47B 23/00

[52] U.S. Cl. ..... 108/42; 108/108

[58] Field of Search ..... 108/152, 47, 108, 108/157.13, 157.16, 157.18, 157.1, 137, 143, 102; 211/87.01, 88.01, 90.01, 90.02, 94.01, 94.02; 248/235, 240, 290.3, 250, 243, 241

[56] References Cited

U.S. PATENT DOCUMENTS

| | | | |
|---|---|---|---|
| 1,453,171 | 4/1923 | Oberwarth | 108/157.16 |
| 1,521,902 | 1/1925 | Mott | 108/42 |
| 3,556,306 | 1/1971 | Shell | 211/90.02 |
| 4,538,784 | 9/1985 | O'Flanagan | 108/108 X |
| 5,156,096 | 10/1992 | Lamprey | 108/108 X |
| 5,613,449 | 3/1997 | Pullman | 211/90.02 X |
| 5,706,740 | 1/1998 | Keller, Jr. | 108/42 X |

*Primary Examiner*—Jose V. Chen
*Attorney, Agent, or Firm*—John D. Gassett

[57] ABSTRACT

A shelf assembly for attaching on a window and taking up very little wall space. A horizontal shelf has tenons on its lower side. A vertical support has a vertical edge and a horizontal edge at right angles. The horizontal edge has mortises for receiving the tenons. The shelf is placed on the top trim of a window and the vertical supports are slid along the trim until they contact the window vertical trim. The vertical supports are then screwed to the window trim.

10 Claims, 3 Drawing Sheets

ADJUSTABLE SHELF FOR USE ABOUT AN OPENING IN A WALL

FIELD OF THE INVENTION

This invention relates generally to the area of shelves. It relates especially to shelves for use on walls while taking up essentially no wall space.

Shelves have been used for ages and can be defined as a thin, flat, usually long and narrow piece of material such as wood fastened horizontally on a wall at a distance from the floor to hold objects such as books, vases, photographs and so forth. These shelves are usually secured to a flat wall for example by nailing or screwing right angled braced brackets to the wall. The brackets are frequently fastened into the wall studs to give added strength. A narrow piece of wood or other material is placed on top of the bracket and secured to the bracket by means such as by screws. The bracket and shelf on the wall are all then fixed together.

These prior shelving take up a considerable amount of wall space. There is a need for a shelf assembly that occupies essentially no or very little wall space.

BRIEF DESCRIPTION OF THE INVENTION

This invention describes a shelf assembly for attaching about an opening (such as a window or a door) in a wall. The shelf assembly includes a horizontal shelf having a length and a width and a first end and a second end. It also includes a first and a second vertical support which typically is a member having a vertical edge and a top edge which are at essentially ninety degrees to each other. The two vertical supports are preferably connected to the under side of the shelf by modified dovetail sliding joints in which a tenon is supported from the lower side of the shelf at each end and extends in a direction toward the other end of the shelf and along its length. Each vertical support has in its top edge a mortise for receiving the tenon such that the vertical support can slide along the tenon on the under side of the shelf.

This shelf assembly can be assembled about an ordinary window opening. The following describes a typical installation about the window. If one wants the shelf to be symmetrical about the window one first marks the center of the top trim of the window. The longitudinal center of the shelf is marked. The two upright support members are placed on the tenons on the under side of the shelf. The shelf is then placed on the top of the top trim of the window opening and the two marked centers are aligned. The vertical supports are moved until they abut the vertical trim on the side trim of the window. Preferably, a nail or screw is driven through the shelf from the top into the top window trim to hold the shelf assembly steady. At this time the vertical support members may be nailed or otherwise secured by any suitable means such as screws to the vertical side window trim. I then have a very stable shelf solidly supported and takes up essentially no wall space. Further, this novel shelf assembly can be used on windows of various width dimensions. This is accomplished in the above described procedure by moving the upright members horizontally along the tenons on the underside of the shelf until the upright support members contacts the edge of the trim.

This shelf assembly can be used at vertical positions up and down the window other than at the top. For example, the shelf can be positioned at about the halfway mark up and down on the window. In that case, the vertical support members would be secured to the outside of the window side trim and would be the sole support for the shelf inasmuch as in this position the shelf is not supported on top of the top trim. In a modified embodiment, a notch can be cut out of each end of the shelf on the side toward the window. The notch would be relatively along, but not all the way of, the length of the shelf and would have width of varying dimensions. The shelf would then be assembled as described, but the uncut portion of the shelf would extend into the window space proper and give an additional shelf space.

This assembly can be used on an opening between rooms and could be installed generally as just described.

Therefore, it is an object of this invention to provide a novel shelf assembly which can be adapted to fit within range limits varying with doorway or window sizes and attached thereto and take up essentially no otherwise usable wall space.

It is another object of this invention to provide upright support means which are slidably secured to a shelf member so that the shelf assembly can be used for various windows.

These and other objects will become easily understood and apparent from the following detailed description taken in conjunction with the drawings in which:

DETAILED DESCRIPTION OF THE PREFERRED EMBODIMENT

Figure 1:
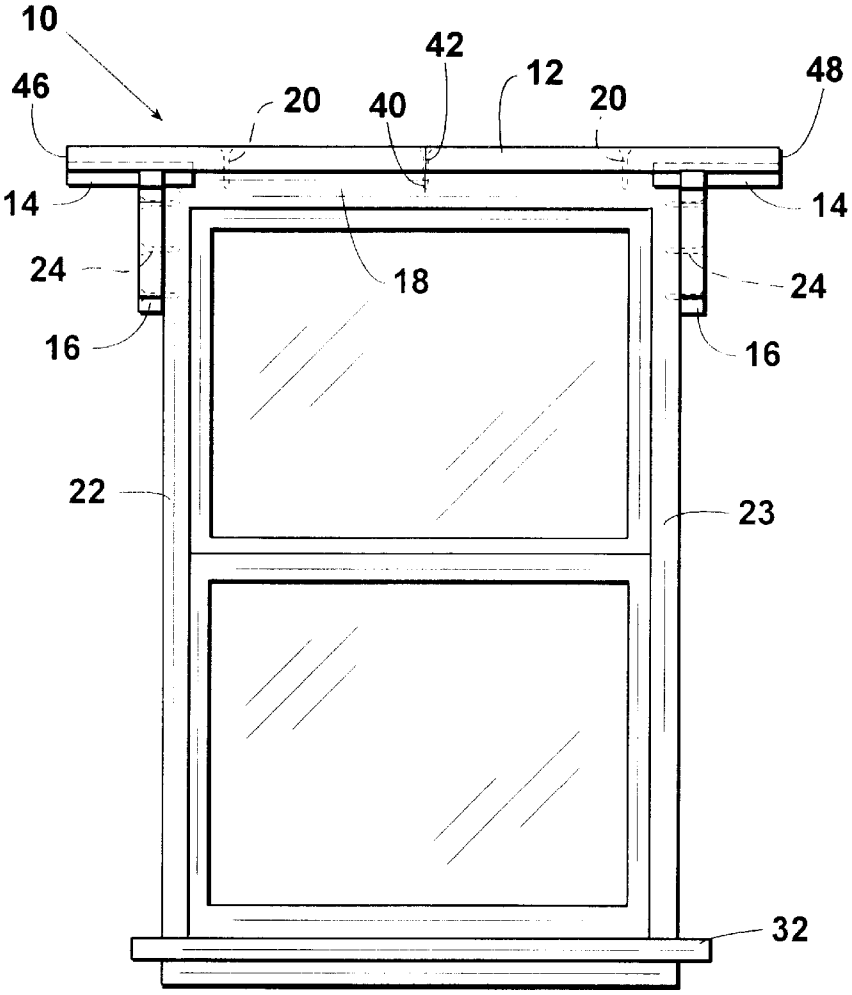
FIG. 1 illustrates a window including side and top trim with my adjustable shelf secured hereto.

Attention is first directed to FIG. 1 which shows my adjustable shelf assembly 10 mounted upon the top of the window having a vertical trim 22, 23 on each side of the window opening and a top trim 18. This window can be a conventional window having an upper and lower sliding or nonsliding glass members and of course comes in a wide range of dimensions.

The shelf assembly includes a horizontal shelf 12 having a length "L" (FIG. 5) and a width "W" (FIG. 5) and two vertical supports 16, one on the left vertical trim 22 and the other adjacent the right vertical trim 23. The vertical supports 16 are secured to vertical trim 22 and 23 such as by screws 24 for example. Shelf 12 preferably is secured to the top trim such as by screws 20, or nails, etc.

Figure 3:
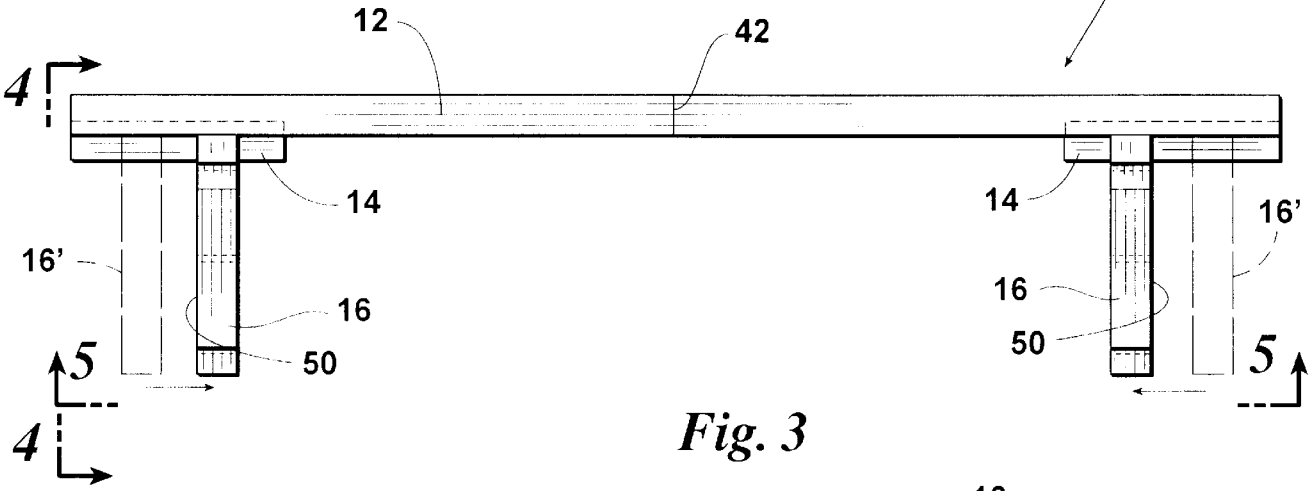
FIG. 3 is a front view of my adjustable shelf unit.
Figure 5:
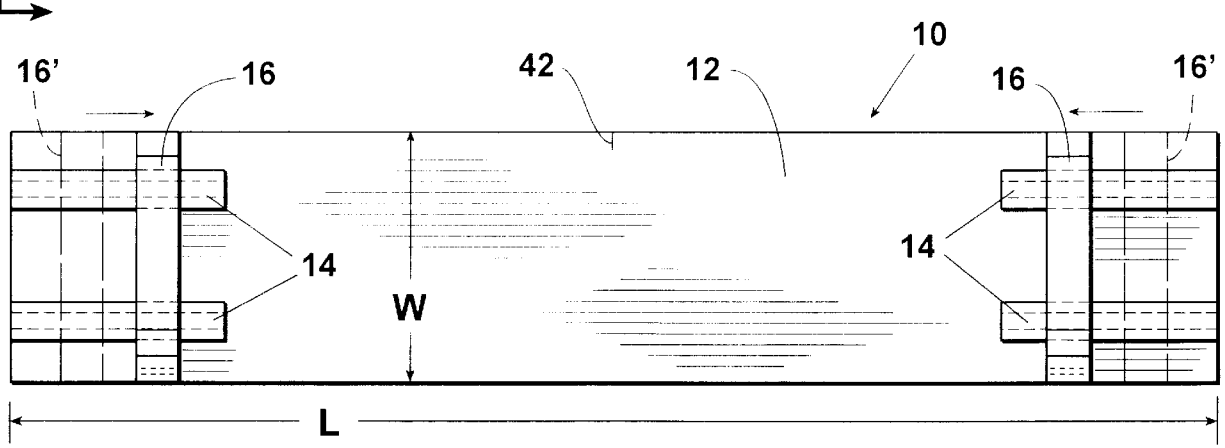
FIG. 5 is a view taken along the line 5—5 of FIG. 3.
Figure 4:
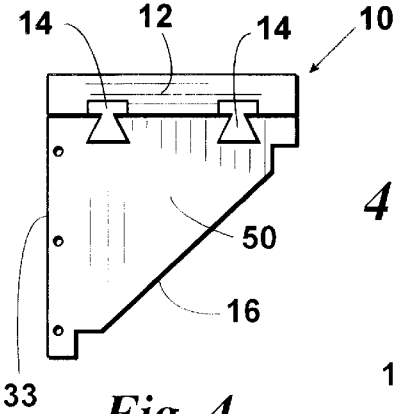
FIG. 4 is a view taken along the line 4—4 of FIG. 3 and is an end view showing the vertical support member supporting the horizontal shelf.
Figure 6:
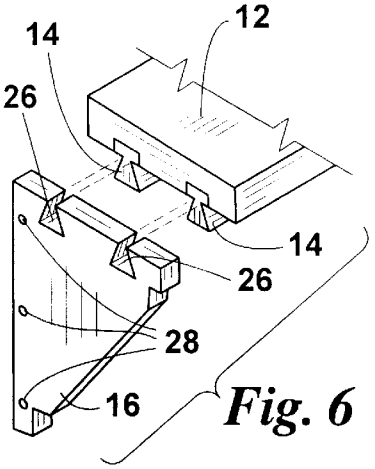
FIG. 6 is an isolated view of one vertical support portion of the top shelf and the sliding connection between the two.

Attention is now also directed to FIGS. 3, 4, 5 and 6 to obtain a better understanding of the shelf assembly. FIG. 3 shows the shelf assembly including the top or horizontal shelf 12 and two vertical support members 16 at or close to either ends 46 and 48 of shelf 12 (FIG. 1). There is a sliding connection between the top of vertical supports 16 and the lower side of shelf 12. As can be seen more clearly in FIGS. 4 and 6 this includes typically a dove-tail like slide or similar and as shown includes two tenons 14 secured to the underside of the horizontal shelf 12 at or near each end thereof. There is provided in the vertical support two mortises 26 into which the tenons slidably fit. These tenons 14 fit rather closely within the mortise 26, but are such that one will slide with respect to the other. As seen in FIGS. 3 and 5, the vertical support 16 can slide between position 16 to position 16'. In this arrangement, once vertical supports 16 are positioned on tenons 14, they cannot fall off as long as shelf 12 is horizontal.

Attention is now directed back to FIG. 1 to aid in an explanation in the installation of my adjustable shelf assembly 10. I first mark the center 40 (midway between the left and right vertical trim 22 and 23) of the top of the top trim 18 and also the center 42 of the top shelf 12 that is midway from one end 46 to the other end 48. I then place shelf 12 on top trim 18 and align the center 42 of shelf 12 marks and center mark 40 of the trim 18 as I place the horizontal shelf 12 on top of the top trim 18. I next slide vertical supports 16 along the tenons 14 until they contact the outer side of vertical trim 22 and 23 as shown in FIG. 1. During this time I maintain the center of the horizontal shelf and the center of the window in alignment. The middle of the window over top trim 18 would be halfway between one of the vertical trims 22 and the other vertical or right hand vertical trim 23. I then secure my assembly to the trim. I can do this by securing screws 24 through the vertical support 16 with each vertical support 16 secured against its respective vertical trim 22 and 23. The relative position of the secured screws 24 is shown in FIG. 1. I can then secure screws 20 to the top of the horizontal shelf 12 and to the top trim 18. The secured positions of the screw are indicated in dashed lines. Of course, other means of securing the shelf 12 and vertical supports 16 to the trim may be used.

Taking into account where the window is with respect to the room corner, etc., if the shelf is not centered on the window one finds where the shelf is to be positioned on the window, then slides the vertical supports to the appropriate position along the tenons to mate the position of the window side trim. Then the shelf is secured to the top trim and the vertical supports 16 are pushed completely against the side trim. The vertical supports 16 may then be nailed, screwed or otherwise attached to the window trim.

As can clearly be seen in FIG. 1, by using my adjustable shelf assembly I have installed a shelf above the top trim 18 of the window and have used very little of the wall space by making the vertical support 16 slidable to be positioned against the vertical window trims 22 and 23. I can use my shelf assembly on a wide range of window widths. In other words I do not need an exact measurement of the window's width upon which my shelf is to be assembled.

Typically, the width of shelf 12 may be about seven inches and the length of tenons 14 can be about twelve to fourteen inches. Typically, notch 34 may have $L_2$ which is about equal to or greater than the length of the tenons 14 and $W_2$ by about one inch. These dimensions reflect a shelf assembly which I have built. Of course, shelf assemblies of other dimensions may be used.

Figure 2:
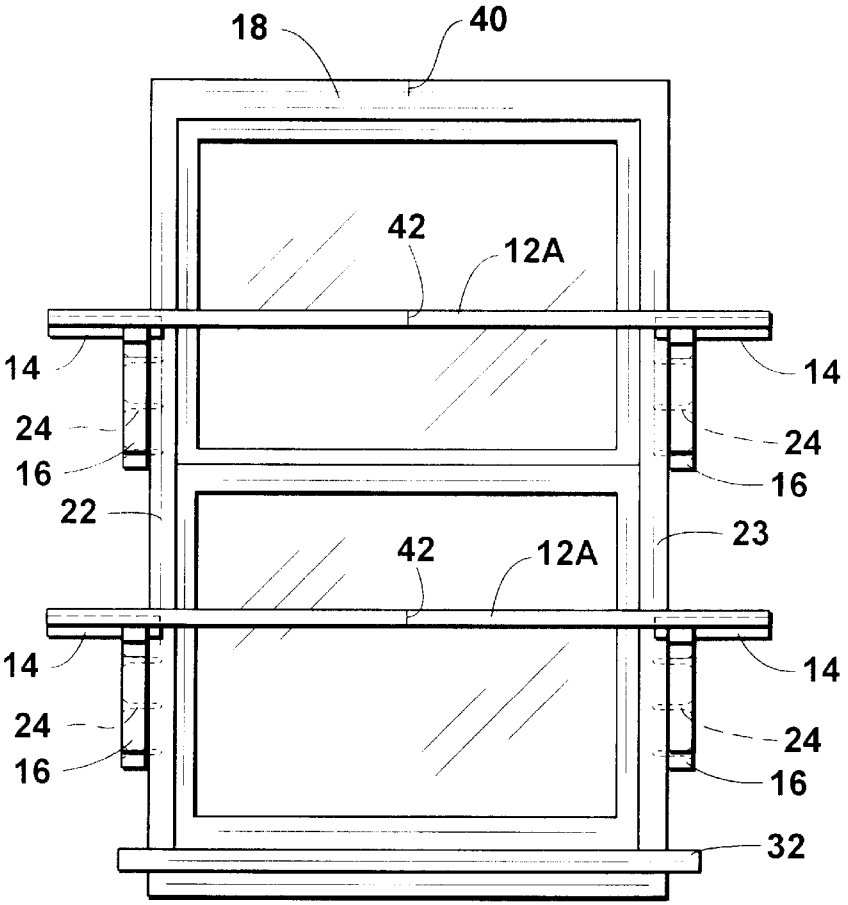
FIG. 2 is similar to FIG. 1 in that it shows a window with top and side trim, but in this case it shows my adjustable shelf attached to intermediate vertical positions between the top and bottom of the window.
Figure 7:
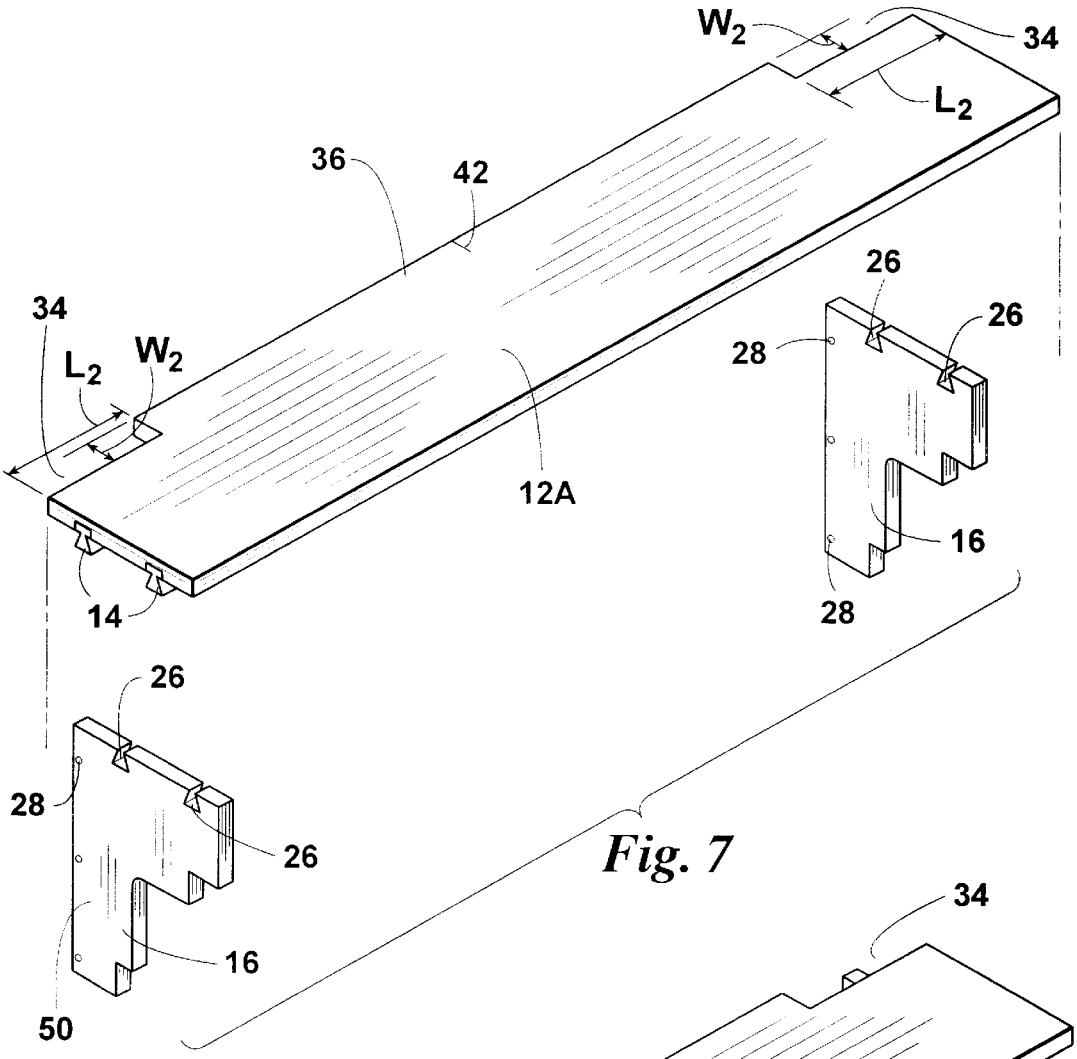
FIG. 7 is an exploded view showing the top shelf and the end support members with the shelf being notched so that a portion of the shelf can fit into the window spaced between the sides thereof.
Figure 8:
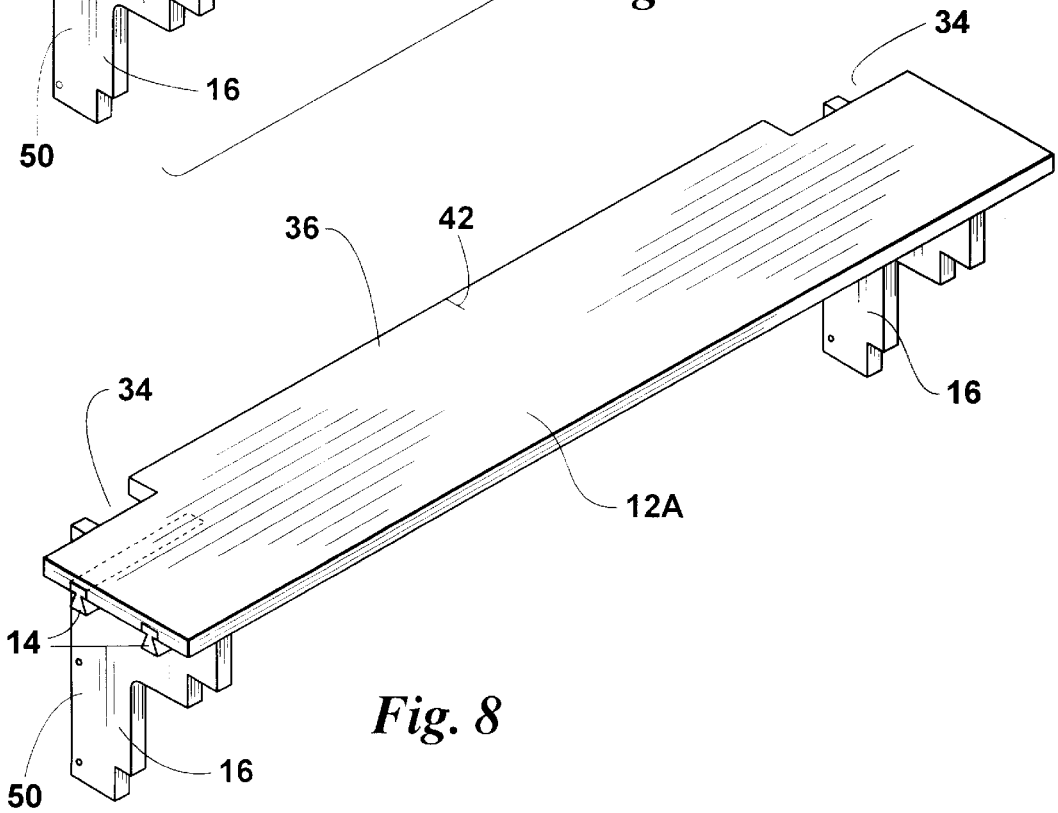
FIG. 8 is the view of FIG. 7 except that the shelf and vertical support members are assembled.

Attention is now directed to FIG. 2 which shows the positioning of my horizontal shelf 12A at intermediate points between the top trim 18 and the window sill 32. For shelf assemblies to be used at these intermediate positions, I prefer to have a horizontal shelf which is shown in FIGS. 7 and 8. In these figures there are two notches 34 having a length $L_2$ and a width $W_2$ cut in the back side of shelf 12A leaving a projection 36 which fits into the window opening between the inside of the left vertical trim 22 and the right vertical trim 23. The notch would be shallow enough not to permit the projection 36 to contact the window proper, especially if it is a sliding window. The vertical support member 16 would be secured to the shelf 12A similar to the securement of that shown in connection with FIGS. 3, 4, 5 and 6. In assembly I lift or lower the shelf 12A to the desired vertical position and align the center mark 42 of the longitudinal length of the shelf 12A with the center mark 40 of the top trim 18 and slide the vertical supports 16 against the vertical trims 22 and 23. In this embodiment, the notch also permits the shelf to avoid the window trim so that the vertical edge 33 of the vertical support 16 can be positioned against the wall next to the window trim. Then I secure these vertical supports 16 to the trims 22 and 23. The screws 24 are illustrated similarly in FIG. 1.

Although I have shown my adjustable shelf assembly installed on windows it can also be installed on doorways, i.e., openings between rooms. If the doorway has trim it can be installed as described above. If the doorway has no trim, then the shelf of FIG. 8 could be used with the outer sides 50 of the vertical support 16 could be placed against the inner surface of the opening of the door and secured thereto.

Thus, it is apparent that there has been provided, in accordance with the invention, a shelf that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A shelf assembly including:

an opening in a main wall in which the opening has trim about it and in which the trim has a surface perpendicular to the main wall;

a top trim;

a shelf having a length and a width and supported on top of said top trim;

a tenon supported on the lower side of said shelf and extending in a direction along at least a part of the length of said shelf;

a first and a second vertical support each having a vertical edge and a top edge, said top edge having a mortise for receiving said tenon such that said vertical support can slide along said tenon on the under side of said shelf;

an edge of said vertical support mating with said perpendicular surface;

whereby said shelf is firmly mounted above said opening in a manner to use only very little of the main wall space.

2. A shelf assembly as defined in claim 1 in which there are two spaced apart tenons under each end of said shelf.

3. A shelf assembly as defined in claim 1 in which said tenon is wedge shaped in cross section such that the lower side of said tenon has a greater dimension than the upper side, and said mortise is shaped to receive the tenon such that when the mortise is placed on the tenon that the vertical support will be in a slidable connected position with respect to the shelf.

4. An adjustable shelf assembly comprising:

a wall including an opening in which the opening has a first vertical trim and a second vertical trim, each vertical trim has an outer edge;

shelf having a length and a width, at each end of said shelf there is a notch having a length $L_2$ and a width $W_2$, the notch width $W_2$ being at least as large a dimension as the thickness of said vertical trim, each notch having an inner edge, the distance between the inner edges being not greater than the distance between the first and second vertical trim;

at least one tenon supported on the lower side of said shelf at each end thereof and extending at least partially along the length thereof;

a first and a second vertical support having a vertical edge, a side edge and a top edge, said top edge having a mortise for receiving each said tenon such that said vertical support can slide along said tenon on the under side of said shelf along said tenon, until said vertical supports contact said outer edges of said first and second vertical trim;

said side edge mating with the vertical trim of said opening such that said shelf extends across said opening.

5. A shelf assembly as defined in claim 4 in which each said vertical support is attached to the outer edge of one of said vertical trim.

6. A shelf assembly as defined in claim 4 in which the tenon is at least as long as $L_2$.

7. A method of attaching a shelf assembly to a wall comprising:

obtaining a shelf assembly which has a shelf having a length and a width, a tenon supported on the lower side of said shelf, a first and a second vertical support each having a vertical edge and a top edge, said top edge having a mortise for receiving said tenon such that each said vertical support can slide along said tenon on the underside of the shelf;

providing an opening in said wall, said opening having a top trim;

placing a top mark at a selected position above the top trim and placing a shelf mark at a selected position along the shelf;

placing the shelf on the top trim and aligning the mark of the shelf and the mark of the trim;

sliding the vertical support along the tenons until they each contact the outer side of the vertical trim;

then securing the assembly to the trim.

8. A method as defined in claim 7 in which the opening has vertical trim, the step of securing the assembly to the trim includes:

securing screws through the vertical support with each vertical support secured against its respective vertical trim.

9. A method of attaching a shelf assembly to a wall which method includes:

providing an opening in said wall and in which the opening has a horizontal surface and vertical surface;

obtaining a shelf assembly which has a shelf having a length and a width, a tenon support on the lower side of said shelf, a first and a second vertical support each having a vertical edge and a top edge, said top edge having at least one mortise for receiving said tenon such that each said vertical support can slide along said tenon on the underside of the shelf, placing a first mark on the opening at a selected horizontal position;

placing a shelf mark on the shelf at a selected position;

aligning said first mark and said shelf mark;

sliding the vertical support along the tenon until they each contact a vertical surface of the opening;

then securing the shelf assembly to the vertical surface of the opening.

10. A shelf assembly for attaching to a main wall comprising:

an opening in said main wall and having a surface perpendicular to the main wall;

a shelf having a length and a width;

a slide supported on the lower side of said shelf and extending in a direction along at least a part of the length of said shelf;

a first and a second vertical support each having a vertical edge, a side edge and a top edge, said top edge having a means for receiving said slide such that said vertical support can slide along said slide on the under side of said shelf;

a side edge of each said vertical support mating with said perpendicular surface;

said shelf firmly mounted about said opening in a manner to use only very little of the main wall space.

* * * * *